US006795561B1

(12) United States Patent
Bank

(10) Patent No.: US 6,795,561 B1
(45) Date of Patent: Sep. 21, 2004

(54) PANEL DRIVE

(75) Inventor: Graham Bank, Suffolk (GB)

(73) Assignee: New Transducers Limited, London (GB)

( * ) Notice: Subject to any disclaimer, the term of this patent is extended or adjusted under 35 U.S.C. 154(b) by 590 days.

(21) Appl. No.: 09/610,533

(22) Filed: Jul. 7, 2000

Related U.S. Application Data

(60) Provisional application No. 60/150,808, filed on Aug. 26, 1999.

(30) Foreign Application Priority Data

Jul. 8, 1999 (GB) ..... 9916091

(51) Int. Cl.[7] ..... H04R 25/00
(52) U.S. Cl. ..... 381/152; 381/190; 381/431
(58) Field of Search ..... 381/152, 190, 381/423, 353, 431; 181/173

(56) References Cited

U.S. PATENT DOCUMENTS

| | | | | |
|---|---|---|---|---|
| 4,003,449 A | * | 1/1977 | Bertagni | |
| 5,115,472 A | | 5/1992 | Park et al. | 381/152 |
| 5,400,414 A | | 3/1995 | Thiele | 381/190 |
| 5,901,231 A | | 5/1999 | Parrella et al. | 381/86 |
| 6,064,746 A | * | 5/2000 | Nakamura et al. | |

FOREIGN PATENT DOCUMENTS

| | | | |
|---|---|---|---|
| EP | 0 599 250 | | 6/1994 |
| GB | 2 052 919 | | 1/1981 |
| GB | 2 343 811 | | 5/2000 |
| WO | 97/09842 | | 3/1997 |
| WO | WO 99/02012 | * | 1/1999 |

* cited by examiner

*Primary Examiner*—Suhan Ni
(74) *Attorney, Agent, or Firm*—Foley & Lardner LLP

(57) ABSTRACT

A loudspeaker is made of a panel supporting bending waves and a transducer covering a substantial portion of the panel surface. At least one constraint, for example a clamp or a mass, is fixed to the panel. Each constraint reduces the mobility of a small area of the panel. Excitation of the transducer excites bending waves in the panel; the constraints discourage simple motion and encourage the production of a plurality of bending waves instead. The constraints can constrain the panel to be excited to produce a good distribution of resonant bending wave modes.

17 Claims, 5 Drawing Sheets

PANEL DRIVE

This application claims the benefit of provisional application No. 60/150,808, filed Aug. 26, 1999.

FIELD OF THE INVENTION

This invention relates to a bending wave panel speaker and a method of driving such a speaker.

RELATED ART

WO97/09842, and U.S. counterpart application Ser. No. 08/707,012, filed Sep. 3, 1996 (now U.S. Pat. No. 6,332,029), which is incorporated herein by reference in its entirety and assigned to the present applicant, New Transducers Ltd., discloses bending wave loudspeakers; such a loudspeaker is illustrated in FIG. 1. In general, a bending wave loudspeaker includes a panel 1 with at least one exciter 3 coupled to the panel 1 at one or more discrete points or small regions. The exciter position or positions is or are selected to drive distributed resonant bending wave modes to cause the panel to emit sound.

Prior art arrangements with discrete exciters have a disadvantage in that it may be difficult in some applications to locate the exciter at the desired preferential locations, as taught in WO97/09842, and counterpart U.S. application Ser. No. 08/707,012. For example, the loudspeaker may be required to be installed in existing equipment, and the required transducer location may not be possible if another component gets in the way. Alternatively, in a transparent speaker using a transparent panel, it may be difficult to position an exciter in a preferred location without creating visual intrusion, since it is difficult to make conventional exciters transparent.

Thus, it would be advantageous to gain the benefits of preferential exciter placement without in fact needing to mount exciters at the preferred locations.

In the related PCT application No. WO00/02417, likewise to the present applicant but published after the priority date of the present application, several arrangements using a transparent loudspeaker panel and an exciter coupled to the panel are disclosed. The exciter may comprise a piezoelectric or electric material over the panel.

Another prior application which describes a transparent flat panel speaker is GB 2052919 to Hitachi Ltd. This application describes a transparent piezoelectric speaker with a piezoelectric layer on one face. As explained in GB2052919, a problem in such arrangements is that the loudspeaker only operates over a narrow frequency band. Although in GB 2052919 some improvement is obtained by choosing an elliptical shape of loudspeaker panel, the results are still less than optimal—the best results presented have little sound output outside 1 kHz to 3 kHz, a very narrow band.

GB 2052919 teaches that essentially only one mode is excited, unlike the arrangements of W097/09842 in which a number of modes at different frequencies may be excited. However, for a good acoustic output over a range of frequencies using resonant bending wave modes, the exciter should excite a number of resonant modes that are distributed in frequency.

Thus, there is a need for improved performance if such speakers are to be useful for any but the most basic of applications.

SUMMARY OF THE INVENTION

According to a first aspect of the invention there is provided a bending wave loudspeaker comprising a panel capable of supporting bending waves and having opposed faces, a transducer extending over a large fraction of one face of the panel and coupled to the panel surface, and a constraint coupled to a discrete small region of the panel constraining the movement of the panel, so that activating the transducer material can excite a plurality of resonant bending wave modes of the panel.

Instead of placing the transducer at a predetermined location, the transducer is spread over a significant part of the panel area and the panel constrained at one or more constraint locations. The large fraction of the panel surface may be at least 60%, preferably 75% or even 90% of the area of the panel. The larger the fraction, the larger the transducer and hence the larger the output power possible. This is particularly useful when the transducer material only provides a small motion for a unit input, as is often the case for piezoelectric material.

The large fraction is preferably substantially the whole surface of the panel and each small region may be small in comparison with the area of the panel.

Each small region may be no more than 10% of the area of the panel, preferably no more than 1%. Furthermore each small region may have a linear size no greater than 20% of the width of the panel, preferably no greater than 10% and further preferably no greater than 4%. Too large a constraint may result in a panel that is very hard to bend and so which is very hard to drive.

The panel may be a panel of a material that is particularly suitable for supporting resonant bending waves in a predetermined operative frequency range.

As mentioned above, one problem that gave rise to the less than adequate results in GB 2052919 is that the piezoelectric exciter did not excite a good distribution of resonant bending wave modes.

In the loudspeaker according to a preferred aspect of the invention, the provision of a localised constraint allows reasonable or good excitation of a plurality of resonant bending wave modes by a transducer that is extended over the surface of a panel.

The transducer may comprise a sheet of transducer material extending over a large fraction of one face of the panel and coupled to the panel surface.

In another aspect of the present invention, a second transducer may be applied to the opposite face of the panel, in what is known as a"bimorph" configuration. The further transducer may comprise a sheet of transducer material extending over the large fraction of the opposite face of the panel to the first transducer.

A bimorph configuration provides a number of additional advantages. Firstly, the plate is then sandwiched between two transducer sheets; these can be arranged so that the top sheet shrinks as the bottom expands to provide a true bending stress to the plate, rather than just a linear stress applied to one face as occurs in arrangements with only one sheet of transducer material (known as a unimorph).

Moreover, the panel and transducer sheets then form an integral unit which can be optimised as a unit, for a good distribution of resonant bending wave modes.

The constraint may be a mass fixed to the panel, for example on one face or embedded within the panel.

The constraint may also be a rigid coupling piece coupled to the panel over a small region of the panel for substantially impeding movement of that small region.

The constraint locations may be selected so that the resonant bending wave modes of the constrained panel, especially those at the lower end of the operative frequency range, are spaced beneficially for a desired acoustic result. The location and parameters of the constraint may be selected to substantially optimise the acoustic output.

The locations of the constraints may be determined by mathematical or numerical methods, or even systematic experiment.

In a preferred aspect of the invention, the constraints can be located at suitable locations for mounting a conventional small exciter on a free panel. Rather than drive a free panel at a discrete location the panel is driven over a large fraction of its surface and "pinned" at the location that would be suitable for driving it using a local transducer. Thus, the loudspeaker according to this embodiment of the invention is effectively an inverse of a conventional distributed mode loudspeaker, with a localised constraint instead of a localised transducer.

In yet another embodiment, the constraints may be located away from the edges, i.e. at least 20% of the width of the panel away from the edges. By width, it is meant the distance across the panel, in a direction generally orthogonal to the length of the panel. Alternatively, the constraints can be located at asymmetric locations. If the panel is of symmetric form having one or more axes of symmetry the constraints may be spaced away from one or all of the axes of symmetry, for example by a distance of at least 3% of the width of the panel, preferably at least 5%.

Such a constraint location is not always possible. Accordingly, the constraints may be located at the edges of the panel, or at least located no further from the edge than 20% of the distance across the panel from the edge. This is particularly useful in the case that the central region of the panel is required to be transparent.

The sheet or sheets of transducer material may be sandwiched between a pair of electrodes to make a transducer film. The electrodes may be deposited on either side of a transducer film; and they may be transparent. One suitable transparent electrode material is indium tin oxide.

A transducer film can be glued to cover one or both faces of the panel. One electrode of the pair of electrodes may cover the large fraction of one face of the panel and mechanically couple the transducer material to the panel.

The transducer material can be shape-changing when electricity is applied. Accordingly, the material can be a piezo-electric material, such as lead lanthanum zircouite titanate (PLZT) or polyvinylidene fluoride PVDF.

In a preferred embodiment, the panel and the piezoelectric material can be transparent. This is particularly useful combined with transparent panels.

The panel can be suspended or otherwise supported in such a way that the supports have as little effect on the resonant modes as possible.

Alternatively, the panel can be supported by the constraints, or the panel can be supported on a frame as is conventional in bending wave panels. In the latter case, the constraints may simply restrain panel movement at predetermined locations.

In another aspect, a method of making a bending wave loudspeaker having a panel with opposed faces, includes determining the shape, size and properties of a panel, selecting the properties of a sheet of transducer material to be applied over a selected large fraction of a face of the panel, selecting the location of at least one small region and the parameters of the at least one constraint to be applied to the panel on the at least one small region so that the panel provides useful acoustic action, and making a loudspeaker from a panel as determined by applying the selected transducer material over the large fraction of a face of the panel, and applying selected panel constraints at the selected small region using the selected constraint parameters.

BRIEF DESCRIPTION OF THE DRAWINGS

For a better understanding of the invention, and purely by way of example, specific embodiments of the invention will now be described with reference to the accompanying drawings, in which.

DETAILED DESCRIPTION

Figure 1:
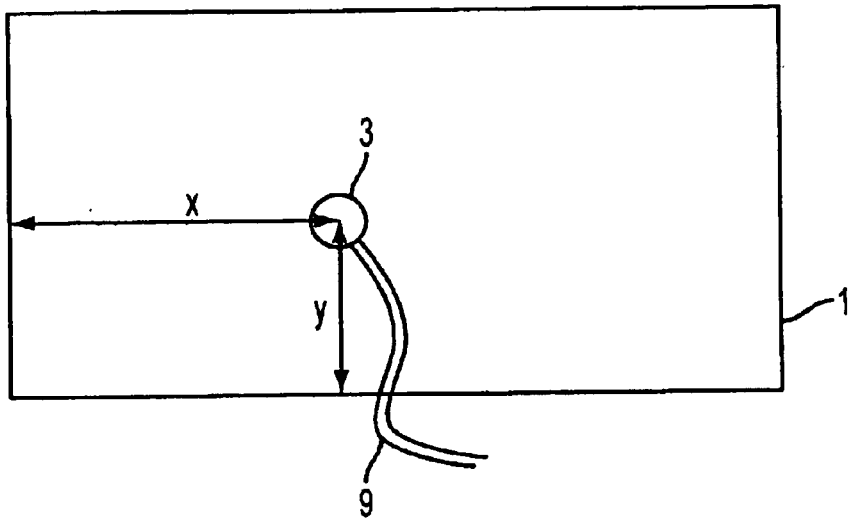
FIG. 1 PRIOR ART
FIG. 1 shows a conventional bending wave panel loudspeaker.
Figure 2:
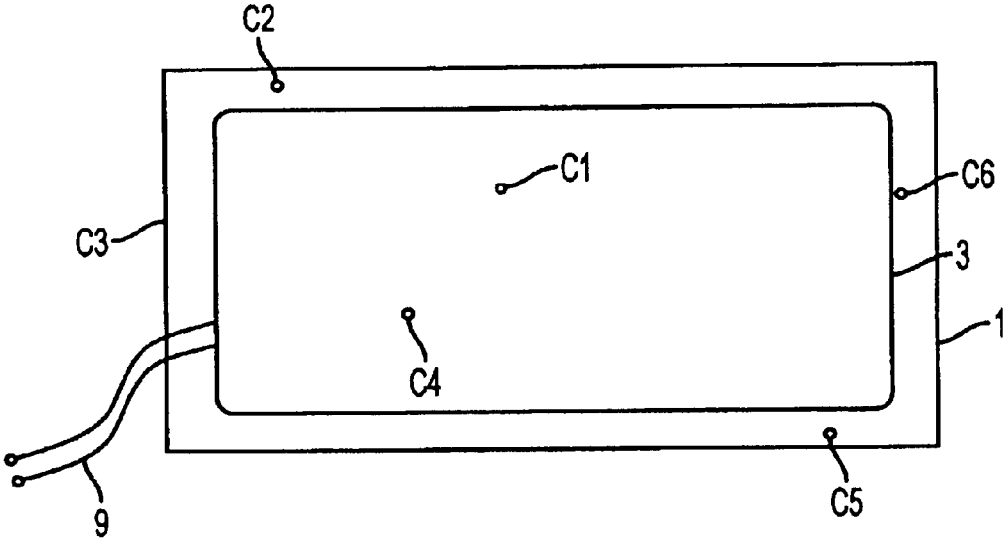
FIG. 2 shows a schematic top view of a loudspeaker according to the invention.
Figure 3:
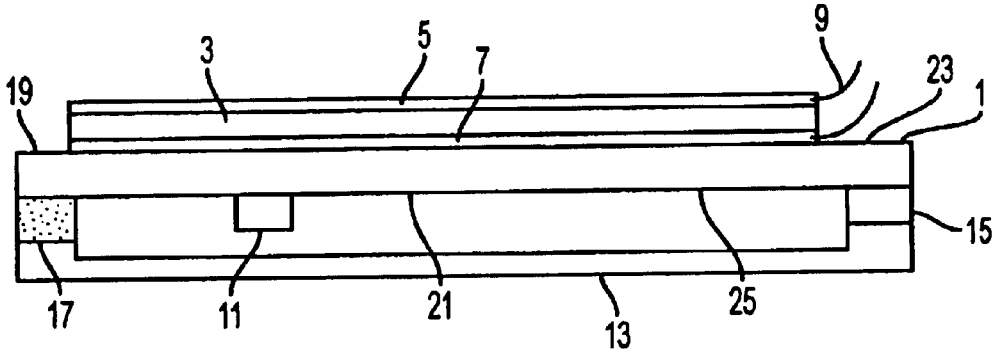
FIG. 3 shows a side view of a loudspeaker according to an embodiment of the invention.

In general terms, as shown in FIGS. 2 and 3, a loudspeaker according to an embodiment of the invention includes a panel 1, with opposed top 23 and bottom 25 faces. The panel need not be flat, but can be made to have a form required for a particular application. Panel 1 is shown in FIG. 2 as being generally rectangular. However, panel 1 can take a number of shapes, such as elliptical, super elliptical, polygonal and irregular shapes.

A transducer layer 3 is provided over a substantial fraction of one face of the panel. Signal connectors 9 provide the loudspeaker input, generally in the form of an electrical signal.

At least one constraint which may be a clamp, a mass, or the like, is applied at one of the locations C1–C6 shown. To mass-load the panel, a mass is fixed or coupled to the panel; to clamp the panel, the panel is locally coupled to a rigid support.

The choice of location for the constraint will now be briefly discussed. The approach according to a preferred aspect of the invention is, in some sense, the inverse of a conventional distributed mode approach such as described in W097/09842. Instead of driving a panel at a selected drive point the panel is driven over a substantial part of its surface and pinned at one or more discrete locations.

A good starting point for a location for the constraint is a preferred drive location, such as taught in W097/09842. Thus suitable constraint locations are generally spaced away from a substantial number of lower frequency nodal lines and these are normally spaced away from both the edges and axes of symmetry.

Locations such as C1 and C4, shown in FIG. 2, in which the constraint is located at a distance of at least 10% of the width of the panel from the edges of the panel can be suitable. The chosen location may also be at least 5% of the width of the panel from axes parallel to the edges of the rectangle and passing through the midpoint of the panel.

If a constraint location in the interior of the panel is impracticable then edge constraint locations such as C2, C3, C5 or C6 may be used.

Figure 5:
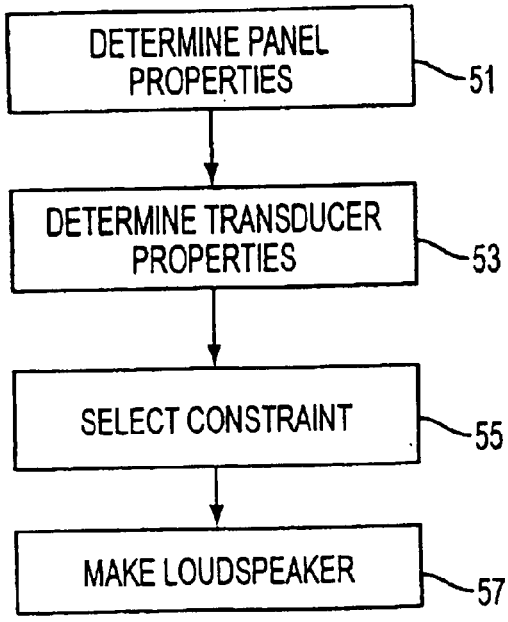
FIG. 5 shows a flow chart of a method of making a loudspeaker according to the invention.

To design a panel the following method may be used, as illustrated in the flow chart of FIG. 5.

Firstly, the required shape, size and properties of a panel are determined (step 51); these are generally set by other factors such as the application in which the loudspeaker is to be incorporated.

Then, a suitable choice of transducer material is made (step 53). The area over which the transducer material is to be applied is then selected; this may be as large as possible for maximum acoustic output.

The panel as designed so far is unlikely to give an acceptable acoustic result. To deal with this problem, the location of at least one small region and the parameters of at least one constraint to be applied to the panel are selected (step 55). This step may be carried out by calculation, such as finite element analysis, or by systematic experiment.

The constraint parameters and locations may be selected to give usefully even acoustic output. A useful figure of merit to optimise is presented in W099/41939, and counterpart U.S. application Ser. No. 09/246,967 (now U.S. Pat. No. 6,427,016), to New Transducers Ltd and incorporated herein by reference.

In embodiments of the invention where the panel is required to be transparent, then providing a constraint mass or clamp in the interior of the panel may not be practicable, since the constraint mass may then interfere with the transparency of the loudspeaker as a whole. In such cases, it may be preferred to clamp the panel at one or more discrete locations around the edge of the panel. Suitable locations are those taught to be suitable edge drive locations in WO 99/37121, and counterpart U.S. application Ser. No. 09/233,037 (now U.S Pat. No. 6,522,760), to New Transducers Ltd and those taught to be suitable edge clamp locations in WO 99/52324 to New Transducers Ltd. Both documents are incorporated herein by reference. Locations around 0.38 to 0.50 of the distance along the length of an edge may be particularly suitable.

Clamping is particularly suitable as a way of providing the constraint at constraint locations at or close to the panel edge. Nearer the center of the panel, it may be more convenient to provide the constraint by adding mass. These choices may however be varied to suit any particular design, as would be apparent to one of skill in the art given the present description.

When suitable constraint locations and types have been selected, a loudspeaker is made (step 57) having a panel as determined with the selected transducer material applied over the large fraction of a face. The constraints selected are applied to the panel at the selected small region using the selected constraint parameters.

Purely by way of example, a specific embodiment of the invention will now be described with reference to FIG. 3. A panel 1 with opposed top and bottom faces (19,21) has a piezoelectric transducer layer 3, of lead lanthanum zirconite titanate (PLZT), applied over the central region of the top face 19 of the panel 1. The piezoelectric layer 3 is sandwiched by top and bottom electrodes 5, 7 connected to electrical input wires 9. The bottom electrode 5 covers the central region of the panel, a large fraction of the area of the panel, and couples the transducer layer 3 to the panel 1.

The panel is mounted in a frame 13 on a soft resilient coupling 17 coupled to the outer part of the bottom face 21 of the panel.

To mass-load the panel at position C4 (FIG. 2), a mass 11 is fixed to the panel at that location. To clamp the panel at location C6 (FIG. 2), the panel is rigidly coupled to the frame 13 by rigid coupling piece 15 at that location, instead of the resilient coupling 17 used elsewhere.

Figure 4:
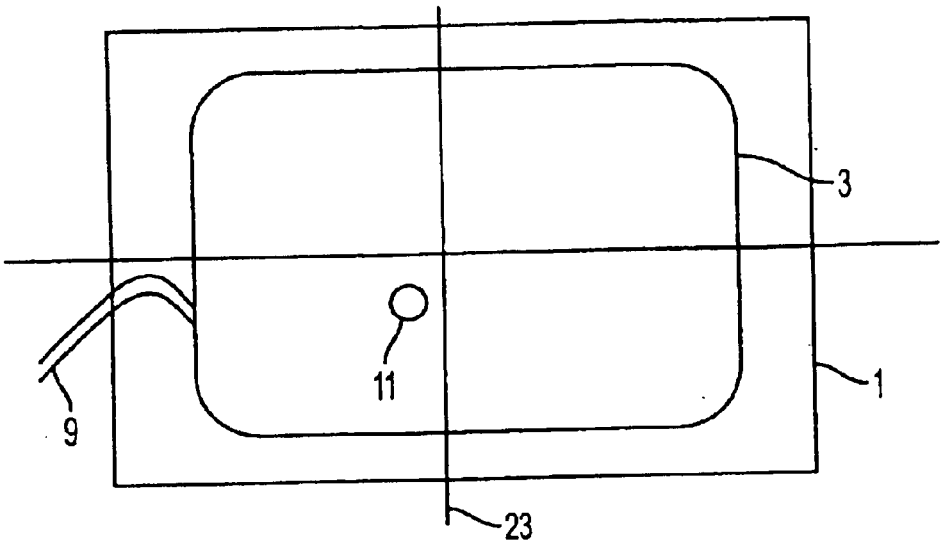
FIG. 4 shows a top view of a loudspeaker according to another embodiment of the invention.

Another preferred embodiment of a loudspeaker will now be described with reference to FIG. 4. A lightweight multimedia loudspeaker has a panel 1 of weight 10 g and of rectangular form with an aspect ratio, i.e. a ratio of length to width, of 1.3:1. A constraint mass 11 of 10 g is affixed to the rear face of the panel at a position 4/9 of the length of the panel from one end and 3/7 of the width of the panel from one side, i.e. spaced away from axes 23. Substantially the whole of the front face of the panel is covered by a piezoelectric electrode sandwich structure 3,5,7 as described above. The electrode sandwich is spaced laterally away from the edges of the panel. The panel is supported on a foam support 15.

Figure 6:
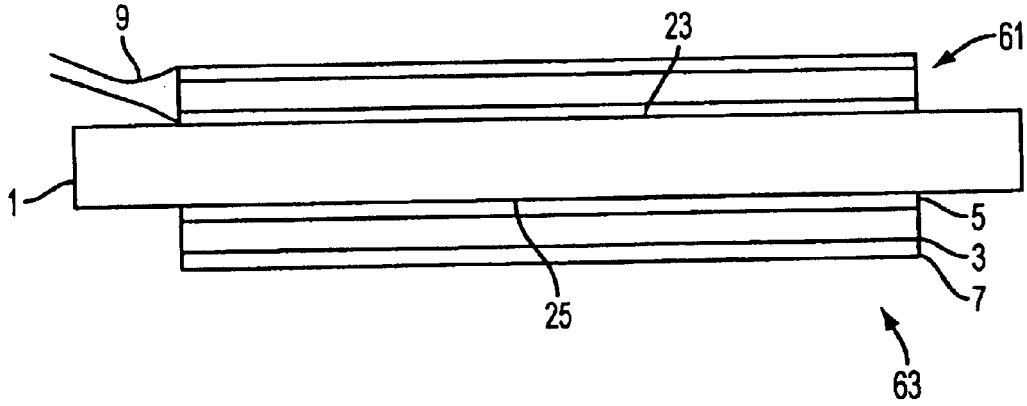
FIG. 6 shows a side view of a panel of another embodiment of the invention.
Figure 7:
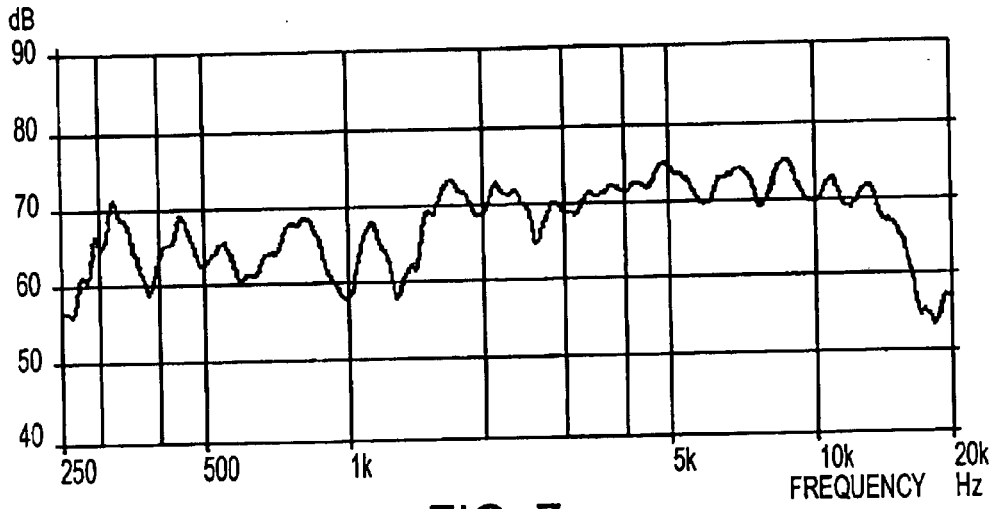
FIG. 7 shows the sound output of a loudspeaker according to the embodiment of FIG. 6.

A further preferred embodiment will now be described, with reference to FIGS. 6 to 8. In this embodiment, two piezoelectric layers are provided, one on each side of the panel. The panel is thus a bimorph.

For example, a rectangular panel 1 was made of 1 mm thick Rohacell of length 150 mm and width 135 mm. Two pieces of commercially available polyvinylidene fluoride (PVDF) film with electrodes provided by the manufacturer were attached to the panel, one on each side of the panel. so that the panel was sandwiched. The film used was manufactured by the Pennwalt corporation, of Norristown, Pa. USA and sold under the name"Kynar Piezo Film sample type S028K". The film includes a polyvinylidene fluoride sheet sandwiched by silver electrodes. Each piece of PVDF covered approximately 90% of the area of the rectangular panel 1, leaving the edges clear. The adhesive used was a thermoplastic polyurethane adhesive,"Puro H-25g".

The film used is slightly anisotropic and when a voltage is applied it bends slightly more in one direction, the active direction, than in the direction orthogonal to the active direction. The top and bottom films were both aligned with the active direction parallel to the long sides of the panel.

A 1.2 g mass, such as mass 11 in FIG. 3, to act as the constraint, was applied to the panel at a location 3/7 of the length of the panel from one end of the panel and 4/9 of the width of the panel from one side. For comparison, the mass of the panel was 7 g. The mass is small in size, and thus covers only a small area of less than 1% of the area of the panel.

The following estimates of various panel properties were made, calculated using the measured or known properties of each of the components. The bending stiffness of the panel and the piezoelectric layers was estimated to be 0.9 Nm, the mass per unit area 1.78 $Kg/m^2$, and the mechanical impedance 10.12 Ns/m. The coincidence frequency, i.e. the frequency that the speed of sound in air matches that in the panel, is estimated to be 26.7 kHz. The fundamental frequency is roughly 120 Hz.

The electrodes 5,7 of the upper 61 and lower 63 films were electrically connected together in parallel.

An experiment was performed to measure the acoustic sound pressure level films as a function of frequency produced by the loudspeaker at 0.5 m with a 20V input to the parallel connected. The results are presented in FIG. 7. The loudspeaker gives a useful and even frequency response over a wide frequency range. It should be noted that no transformer was used for the test so the sound output obtained indicates good efficiency.

The slight anisotropy of the films used, mentioned above, means that some of the low frequency resonant modes of the panel are less strongly excited. This gives rise to the slight falling off of power below about 1.5 kHz, seen in FIG. 7. For particular applications, pairs of films can be mounted on each face of the panel, each pair of films having orthogonal active directions, in accordance with the present description. Thus, four films could be used.

Figure 8:
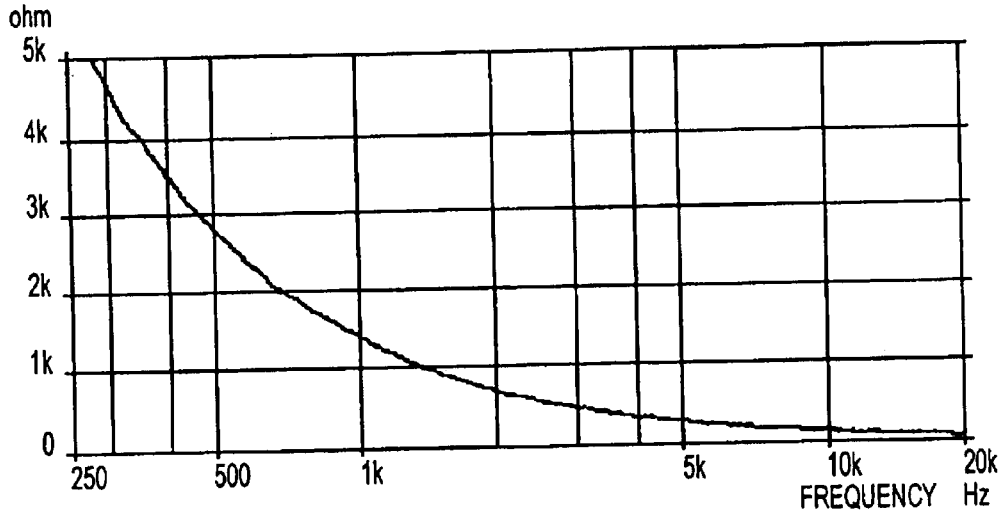
FIG. 8 shows the terminal impedance of a loudspeaker according to the embodiment of FIG. 6.

FIG. 8 shows the electrical impedance presented by the two piezoelectric films. As can be seen, the impedance is higher at lower frequency; this is characteristic of piezoelectric transducers.

The invention is not restricted to the above embodiments, and a number of changes may be made without departing from the scope of the invention. For example, any suitable transducer material that responds to electrical signals may be used, including PLZT or polyvinylidene fluoride (PVDF) as mentioned above. Indeed, the transducer may be an array of microactuators covering a substantial portion of the panel surface.

The electrodes may be made of any suitable conductive material, such as silver, conductive polymer, copper, or the like. The electrodes may be transparent electrodes, for example made of Indium Tin Oxide (ITO).

Fine tuning of the position and type of constraint is possible, either by calculating the correct position or by systematic analysis of the results.

A mass may be fixed to the panel by a variety of fixing means, such as adhesive, adhesive tape, a screw or bolt, or alternative fixings as are known.

A mass may be embedded into the panel, for example in the core material of a core and skins structure. A mass may also be fixed to either or both sides, at or near the center or at the periphery.

The term "clamp" is not intended to be restricted to a conventional clamp and any means fixing one localised region of the panel may be used. For example, it includes a rigid coupling member that rigidly couples one point on the panel to a rigid frame, or one portion of the panel sandwiched between clamp members. The frame itself may be shaped to clamp one portion of the panel. The skilled person will readily devise alternative methods of clamping the panel, i.e. of substantially preventing movement of one region of the panel, given the present specification.

The panel material is capable of supporting bending waves and its size and shape may also be varied as required.

What is claimed is:

1. A bending wave loudspeaker, comprising:

a panel capable of supporting bending waves and having opposed faces;

a transducer extending over and coupled to a large fraction of a panel face; and at least one local constraint coupled to a discrete small region of the panel constraining the movement of the panel, so that activation of the transducer material is capable of exciting a plurality of resonant bending modes of the panel.

2. A bending wave loudspeaker according to claim 1, wherein the transducer includes a sheet of transducer material extending over and coupled to the large fraction of a panel face.

3. A bending wave loudspeaker according to claim 2, wherein the sheet of transducer material is disposed between a pair of electrodes.

4. A bending wave loudspeaker according to claim 3, wherein one electrode of said pair of electrodes covers said large fraction of one face of the panel and mechanically couples the transducer material to the panel.

5. A bending wave loudspeaker according to claim 2, wherein the transducer material is a piezo-electric material.

6. A bending wave loudspeaker according to claim 5, wherein the piezoelectric material is transparent.

7. A bending wave loudspeaker according to claim 1, wherein said constraint is a mass.

8. A bending wave loudspeaker according to claim 1, wherein said constraint is a rigid coupling piece coupled to the panel over a small region of the panel for substantially impeding movement of said small region of the panel.

9. A bending wave loudspeaker according to claim 1, wherein the large fraction of the area of the panel is at least 75%.

10. A bending wave loudspeaker according to claim 1, wherein said small region has a linear size less than or equal to 20% of the width of the panel.

11. A bending wave loudspeaker according to claim 1, wherein said small region has an area less than 1% of the area of the panel.

12. A bending wave loudspeaker according to claim 1, wherein opposed transducers are mounted, one on each of the opposed faces of the panel, over said large fraction of the area of the panel.

13. A bending wave loudspeaker according to claim 12, wherein said transducers include a sheet of transducer material disposed between a pair of electrically conductive electrodes.

14. A bending wave loudspeaker according to claim 1, wherein said constraint is located at a distance away from the edge of the panel of at least 20% of the width of the panel.

15. A bending wave loudspeaker according to claim 14, wherein the panel has an axis of symmetry and the constraint is located spaced away from the axis of symmetry by a distance of at least 4% of the width of the panel.

16. (currently amended) A bending wave loudspeaker according to claim 1, wherein the panel is supported by the constraint(s).

17. A bending wave loudspeaker according to claim 1, wherein the resonant bending wave modes of the panel constrained by the constraint are distributed substantially evenly in frequency.

* * * * *